US010287938B2

(12) United States Patent
Warner et al.

(10) Patent No.: US 10,287,938 B2
(45) Date of Patent: May 14, 2019

(54) SYSTEM AND METHODS FOR REDUCING PARTICULATE MATTER EMISSIONS

(71) Applicant: Ford Global Technologies, LLC, Dearborn, MI (US)

(72) Inventors: James Robert Warner, Grosse Pointe Farms, MI (US); Timothy Brian Chanko, Canton, MI (US); William Charles Ruona, Farmington Hills, MI (US); Giovanni Cavataio, Dearborn, MI (US); Douglas Allen Dobson, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 514 days.

(21) Appl. No.: 14/740,046

(22) Filed: Jun. 15, 2015

(65) Prior Publication Data

US 2016/0363019 A1 Dec. 15, 2016

(51) Int. Cl.

| | |
|---|---|
| ***F02B 43/00*** | (2006.01) |
| ***F01N 3/023*** | (2006.01) |
| ***F02M 25/00*** | (2006.01) |

(52) U.S. Cl.

CPC ..... *F01N 3/023* (2013.01); *F02M 25/00* (2013.01)

(58) Field of Classification Search

CPC combination set(s) only.
See application file for complete search history.

(56) References Cited

U.S. PATENT DOCUMENTS

| | | | | |
|---|---|---|---|---|
| 7,572,416 | B2 | 8/2009 | Alward et al. | |
| 8,496,724 | B2 | 7/2013 | Tokuda et al. | |
| 8,814,974 | B2 | 8/2014 | Beall et al. | |
| 9,327,239 | B2 * | 5/2016 | Morgan | B01D 53/945 |
| 2009/0274602 | A1 | 11/2009 | Alward et al. | |
| 2010/0266461 | A1 * | 10/2010 | Sappok | B01D 39/2093 422/177 |
| 2011/0048227 | A1 | 3/2011 | Beall et al. | |
| 2012/0247085 | A1 * | 10/2012 | Silver | F01N 3/035 60/274 |
| 2013/0306154 | A1 | 11/2013 | Moliere et al. | |
| 2014/0116028 | A1 | 5/2014 | Sappok et al. | |
| 2014/0230409 | A1 * | 8/2014 | Lampen | F01N 3/027 60/274 |
| 2015/0059316 | A1 | 3/2015 | Zhou | |
| 2016/0123201 | A1 * | 5/2016 | Silver | F01N 3/035 60/274 |
| 2017/0021338 | A1 * | 1/2017 | Grubert | B01D 53/9459 |

* cited by examiner

*Primary Examiner* — Lindsay Low
*Assistant Examiner* — Ruben Picon-Feliciano
(74) *Attorney, Agent, or Firm* — Julia Voutyras; McCoy Russell LLP

(57) ABSTRACT

A method for a vehicle comprises responsive to installation of a new exhaust particulate filter, doping fuel with an ash-producing additive, and combusting the doped fuel to produce ash, wherein the ash deposits as an ash coating on the new exhaust particulate filter. In this way, a filtration efficiency of an exhaust particulate filter can be increased quickly as compared to a filter with no deposited ash coating, inexpensively as compared to conventional methods using membranes, and with a lower back pressure drop as compared to conventional methods.

18 Claims, 8 Drawing Sheets

500

SYSTEM AND METHODS FOR REDUCING PARTICULATE MATTER EMISSIONS

BACKGROUND AND SUMMARY

One method for increasing filtration efficiency of gasoline engine exhaust particulate filters includes integrating a membrane layer on the surface of the particulate filter substrate to elevate filtration efficiency while reducing a pressure drop across the filter, and using a high-porosity filter substrate combined with a surface wash coat. However, filters with an integrated membrane layer increase manufacturing costs. Furthermore, high-porosity substrates with surface wash coats may only marginally increase filtration efficiency, dependent on the wash coat amount. Further still, substrates that are heavily loaded with wash coat can exhibit increased filtration efficiency, but only at drastically high filtration back pressures, which can render the filter inoperable.

The inventors herein have recognized the above issues, and have developed systems and methods to at least partially address them. In one example, a method for a vehicle may comprise, responsive to installation of a new exhaust particulate filter, doping fuel with an ash-producing additive, and combusting the doped fuel to produce ash, wherein the ash deposits as an ash coating on the new exhaust particulate filter.

In another example, a method for a new gasoline engine may comprise, installing an exhaust particulate filter, doping gasoline with an ash-producing additive, and combusting the doped gasoline to produce ash, wherein the ash deposits as an ash coating on the exhaust particulate filter.

In another example, a vehicle system may comprise: a combustion engine; a fuel tank; an exhaust particulate filter receiving exhaust from the combustion engine; and a controller with computer readable instructions stored on non-transitory memory for, responsive to installation of a new exhaust particulate filter, doping fuel with an ash-producing additive, and combusting the doped fuel to produce ash, wherein the ash deposits as an ash coating on the new exhaust particulate filter.

In this way, combusting the doped fuel achieves the technical result of producing an ash coating on the new exhaust particulate filter, which can increase the clean filtration efficiency of the filter at mileage levels significantly less than 3000 miles without a membrane, while maintaining filtration back pressure levels.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically shows a vehicle propulsion system.

FIG. 2 schematically shows an engine for the vehicle propulsion system of FIG. 1.

FIG. 3 schematically shows an example of an exhaust particulate filter.

Figure 6:
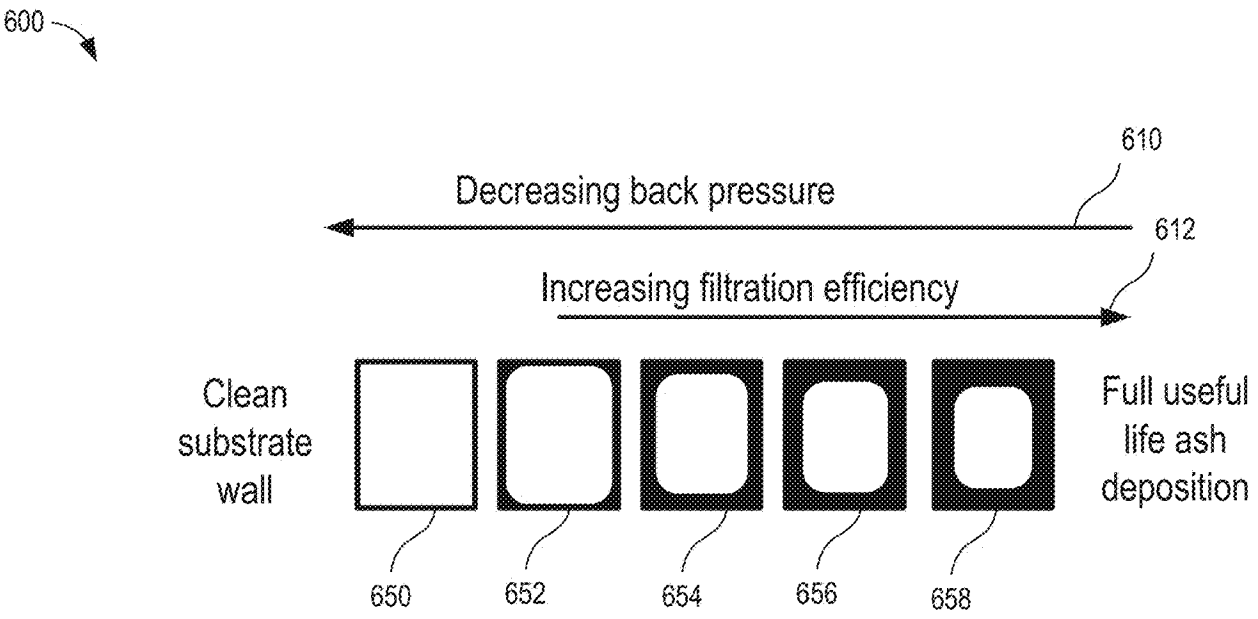

FIG. 6 schematically shows how a cross-section of a filter pore varies as ash is deposited on a clean exhaust particle filter.

Figure 7:
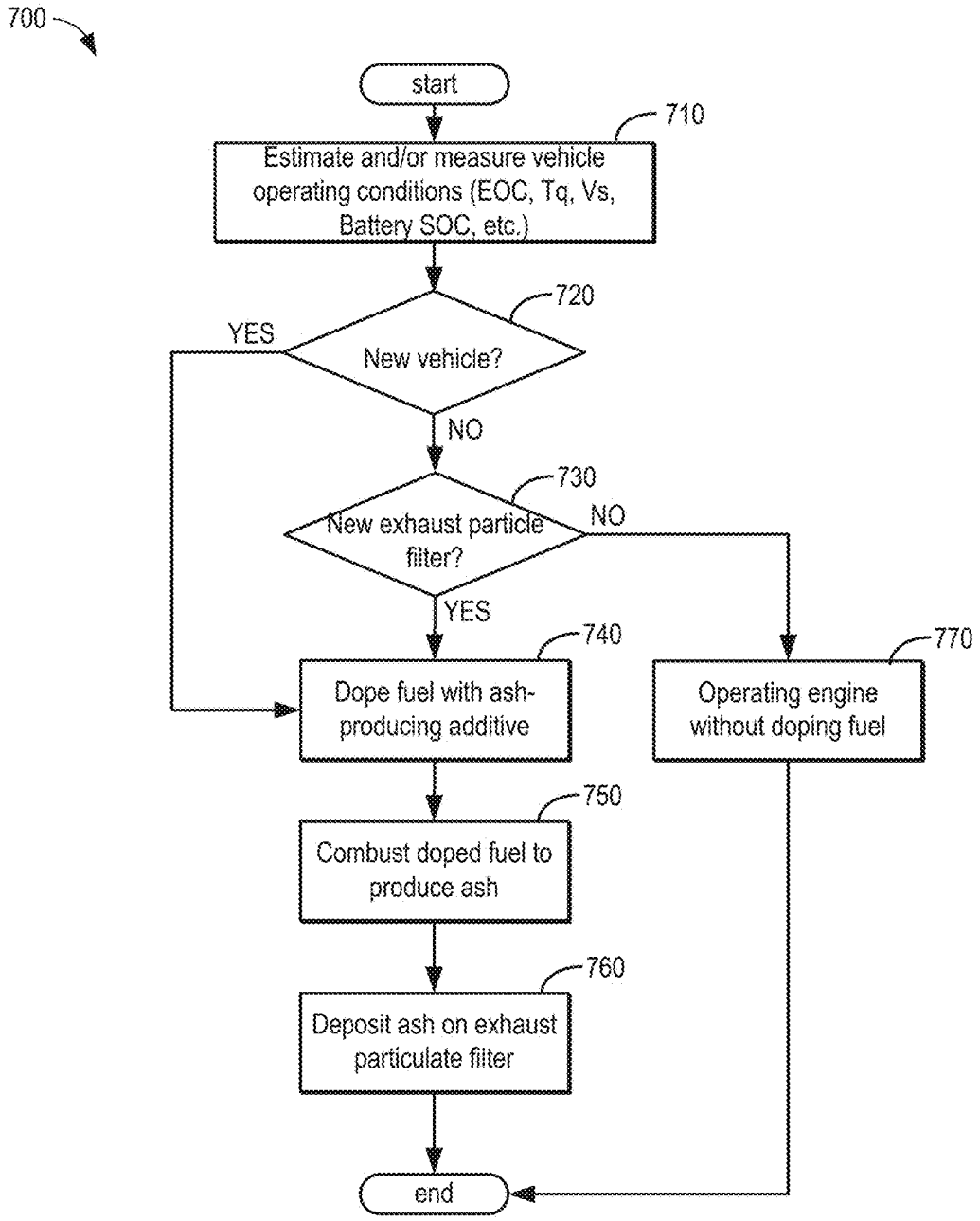

FIG. 7 shows a flow chart for increasing exhaust particulate matter filtration efficiency.

Figure 8:
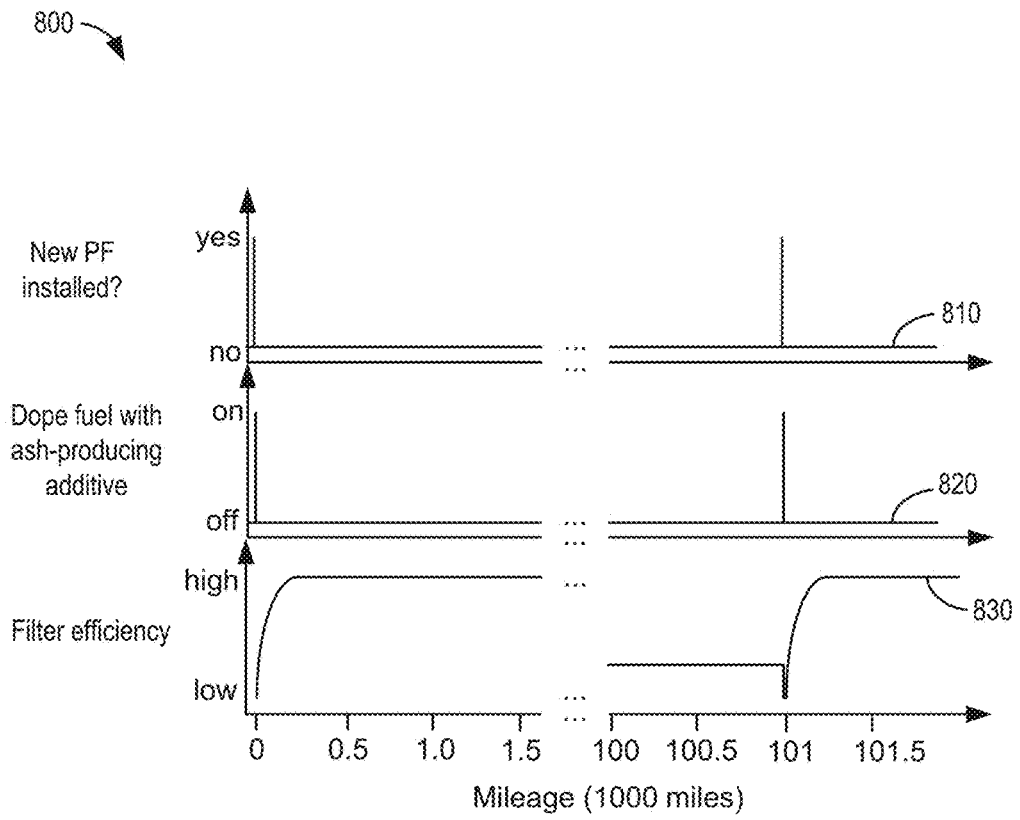

FIG. 8 shows an example timeline for increasing an exhaust filtration efficiency using the method shown in FIG. 7.

DETAILED DESCRIPTION

Figure 1:
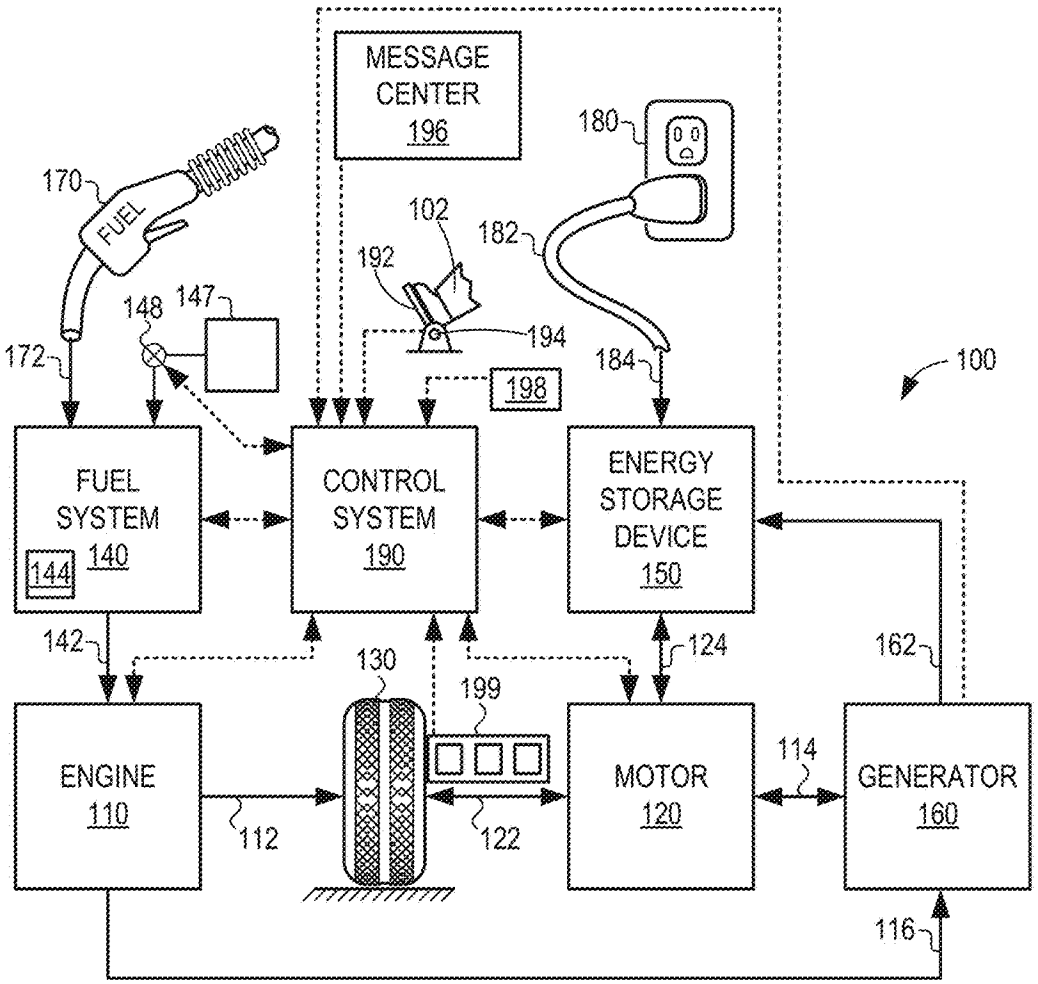
Figure 3:
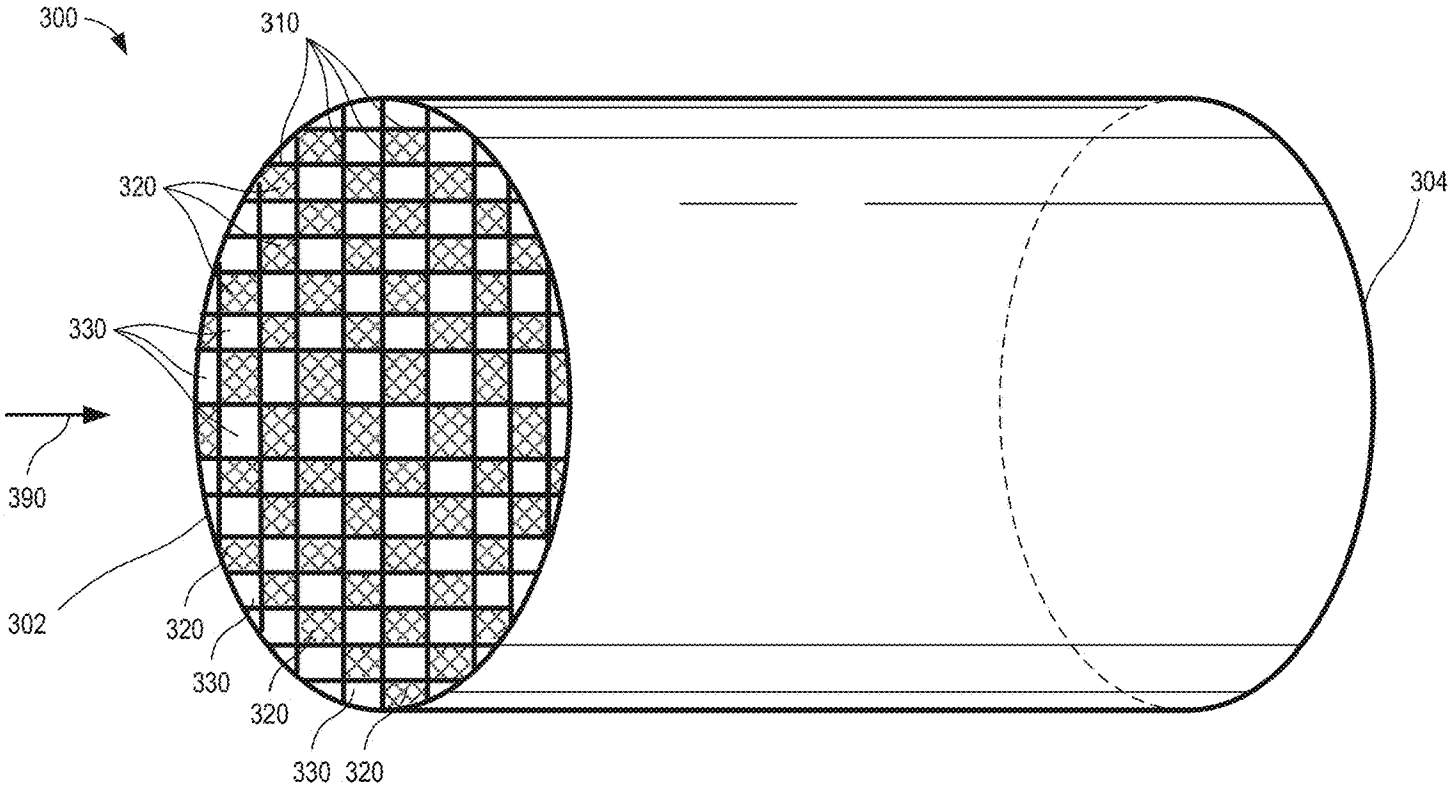
Figure 4:
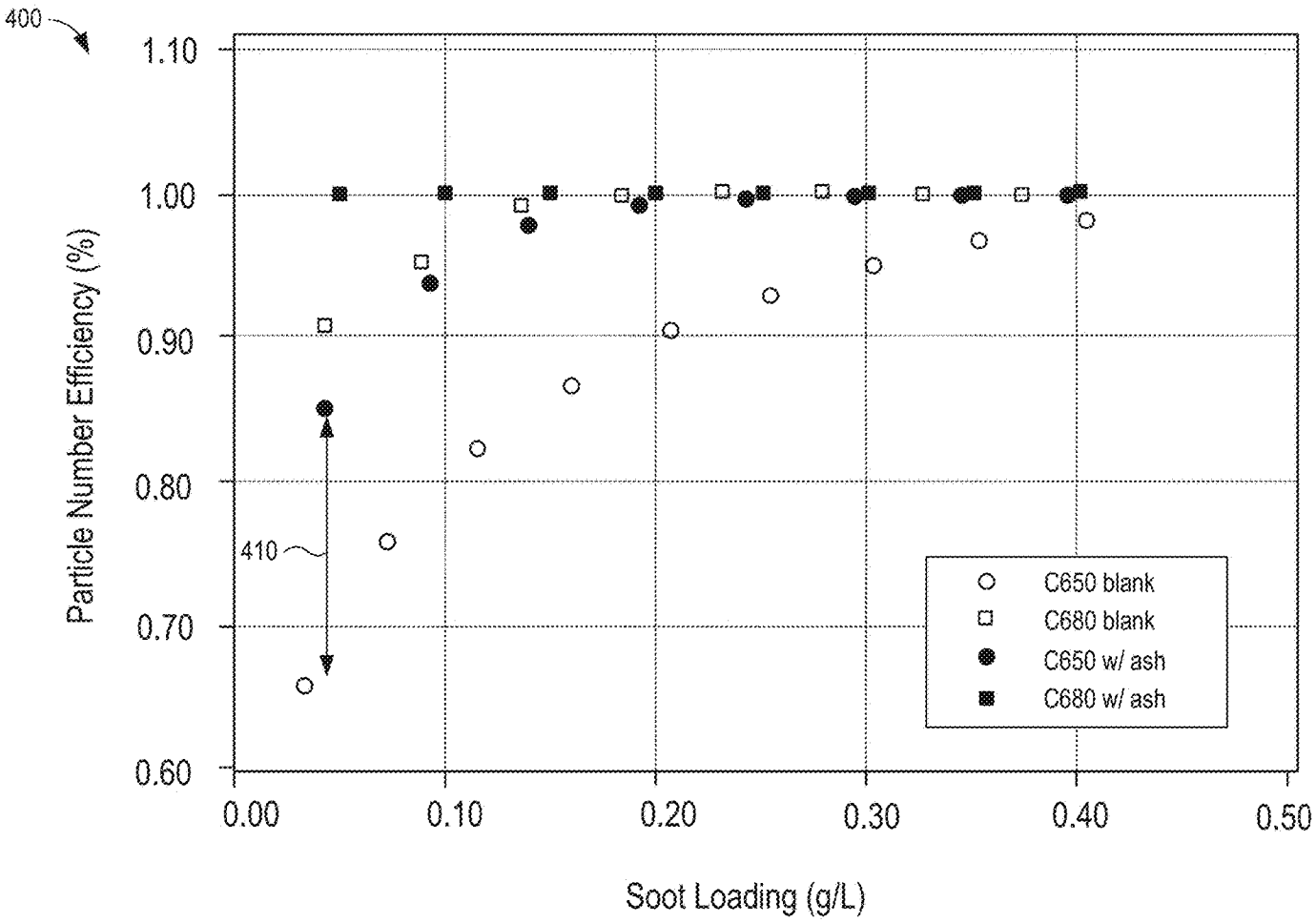
FIG. 4 shows a graph of filtration efficiency and ash loading.
Figure 5:
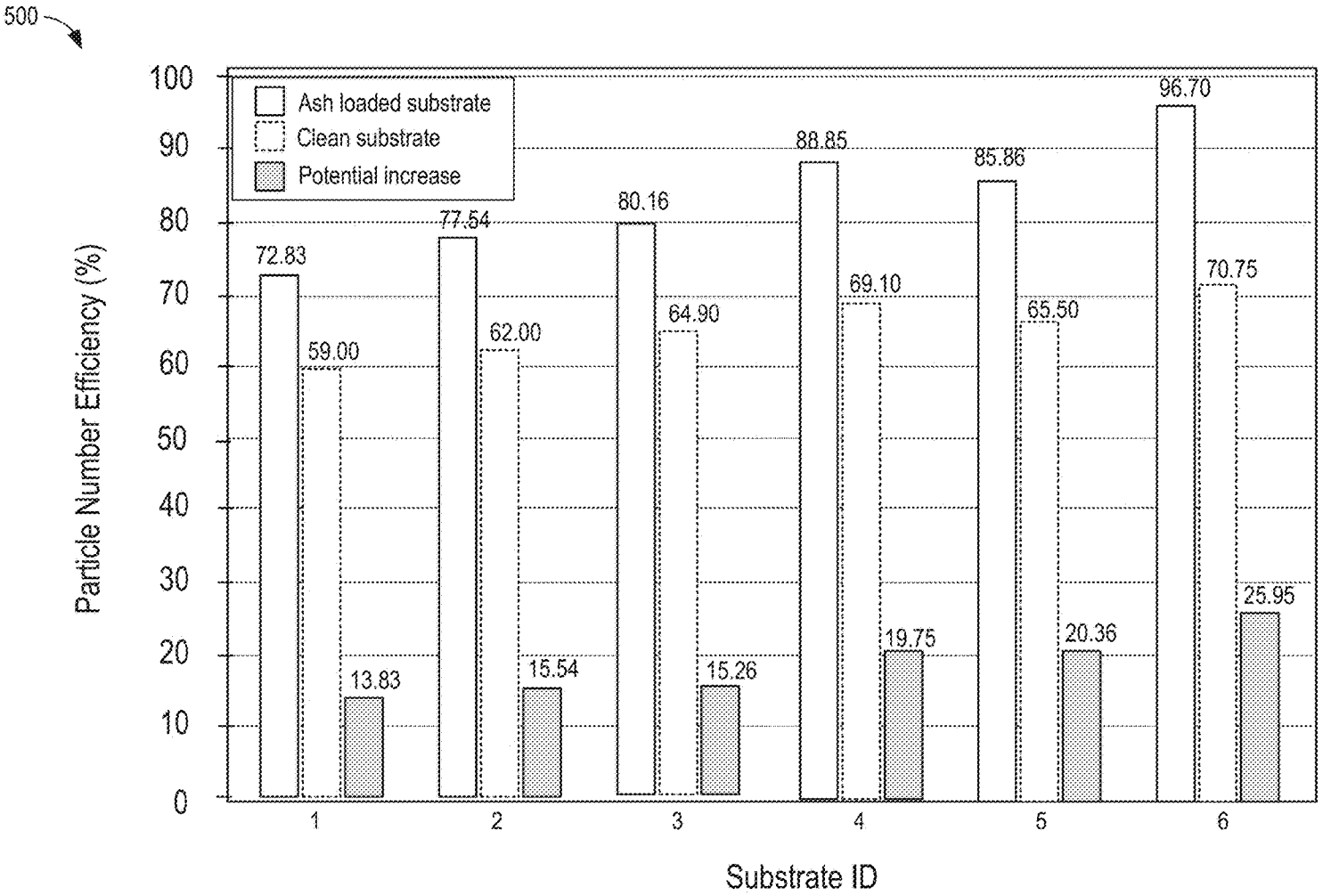
FIG. 5 shows a graph of filtration efficiency for clean and ash-loaded substrates.

This detailed description relates to systems and methods for increasing the efficiency of an engine exhaust particulate filter in a vehicle propulsion system, such as the vehicle propulsion system of FIG. 1. In response to installation of a new exhaust particulate filter (as shown in FIG. 3) in an engine such as the engine of FIG. 2, fuel may be doped with an ash-producing additive. Combustion of the doped fuel produces ash, which deposits as an ash coating on the surfaces of the exhaust particulate filter, as shown in FIG. 6. In particular, FIGS. 4-5 illustrate how the ash coating on an exhaust particulate filter can increase the filtration efficiency of the filter as compared to a clean filter with no ash coating. A controller may perform executable instructions, as shown in the flow chart of FIG. 7, to dope the fuel with an ash-producing additive responsive to installation of a new exhaust particle filter or responsive to a new vehicle. In other cases, an operator may manually dope the fuel with the ash-producing additive in response to an installation of the new exhaust filter. The doping of the fuel responsive to the installation of the new particulate filter and the resulting increase in particulate filter efficiency is illustrated by the timeline of FIG. 8. In this way, combustion of the doped fuel produces an ash coating on the new exhaust particulate filter, which can increase the clean filtration efficiency of the filter at mileage levels significantly less than 3000 miles without costly membranes, while maintaining filtration back pressure levels.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150 such as a battery. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. As described below, ash-producing additives may also be added and blended into the fuel, in the case of a new vehicle or responsive to a newly installed exhaust particulate filter. Ash-producing additives may be stored in a fuel additive storage tank 147 which may be fluidly connected to the fuel tank 144 of fuel system 140 via a fuel additive metering valve 148 that is operated by the control system 190 to control the flow of fuel additives from fuel additive storage tank 147 to the fuel tank 144. Fuel additives such as ash-producing additives may be preloaded and mixed in the fuel additive storage tank 147 for a new vehicle. Additionally, fuel additives may be added to the fuel additive storage tank 147 from an external fuel additive source via a fuel additive dispensing device (not shown). Additionally, fuel additives or fuel doped and pre-mixed with fuel additives (e.g., ash-producing additives, fuel borne catalysts, and the like) may be added directly to the fuel tank 144 from an external source via a dispensing device. For example, in response to an indication at message center 196 of installation of a new particulate filter, a vehicle operator, vehicle technician, and the like, may dispense fuel additives into the fuel tank 144. Furthermore, fuel doped with fuel additives may be blended prior to, during, or after addition to the fuel tank to ensure uniform distribution of the fuel additives.

The engine output may be utilized to propel the vehicle as indicated by arrow 112 or to recharge energy storage device 150 via motor 120 or generator 160. In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flow of FIG. 3, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (state-of-charge).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it will be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. Furthermore, in the case of a new vehicle or in response to a vehicle with a newly installed exhaust particulate filter, vehicle propulsion system 100 may be refueled by receiving a fuel doped with an ash-producing additive. In some embodiments, fuel tank 144 may be configured to store the fuel (and/or doped fuel) received from fuel dispensing device 170 until it is supplied to engine 110 for combustion.

This plug-in hybrid electric vehicle, as described with reference to vehicle propulsion system 100, may be configured to utilize a secondary form of energy (e.g., electrical energy) that is periodically received from an energy source that is not otherwise part of the vehicle.

The vehicle propulsion system 100 may also include a message center 196, ambient temperature/humidity sensor 198, and a roll stability control sensor, such as a lateral and/or longitudinal and/or yaw rate sensor(s) 199. The message center may include indicator light(s) and/or a text-based display in which messages are displayed to an operator, such as a message requesting an operator input to start the engine, as discussed below. The message center may also include various input portions for receiving an operator input, such as buttons, touch screens, voice input/recognition, etc. In an alternative embodiment, the message center may communicate audio messages to the operator without display. Further, the sensor(s) 199 may include a sensor that indicates if a vehicle is new (e.g., vehicle mileage is zero, control system initiated for the first time, and the like) or if a particulate filter is newly installed. These devices may be connected to control system 190. In one example, the control system may provide an audio and/or visual indication at message center 196 responsive to a sensor 199 indicating that a vehicle is new or that a new particulate filter has been installed. In another example, the vehicle system may include an identification label or a bar code that could be electronically scanned that would identify the vehicle system as having a newly installed particulate filter. Accordingly, an operator or vehicle technician may add fuel doped with ash-producing additive to fuel tank 144 in order to generate ash upon fuel combustion for improving the particulate filter efficiency, as described herein.

Figure 2:
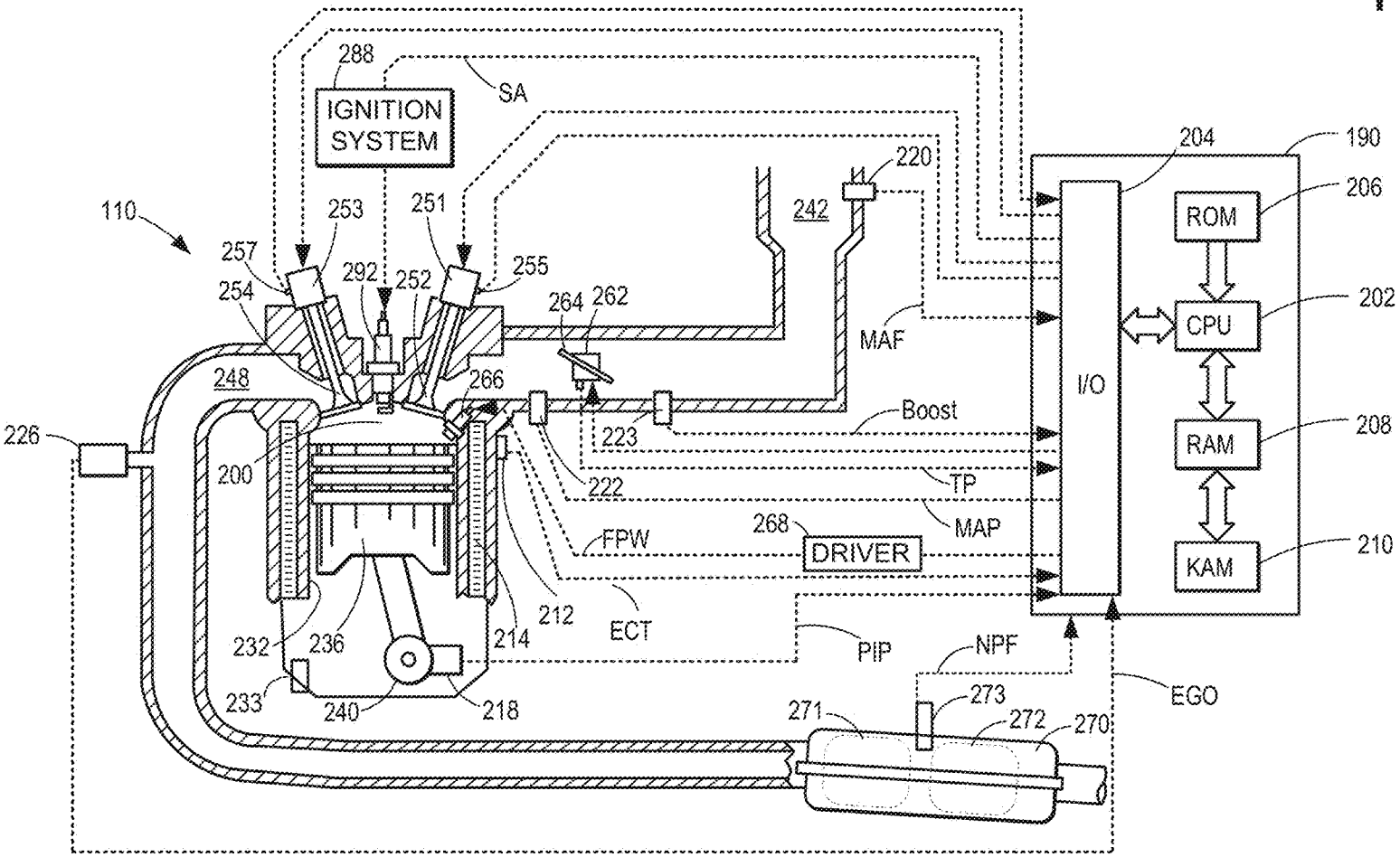

FIG. 2 illustrates a non-limiting example of a cylinder 200 of engine 110, including the intake and exhaust system components that interface with the cylinder. Note that cylinder 200 may correspond to one of a plurality of engine cylinders. Cylinder 200 is at least partially defined by combustion chamber walls 232 and piston 236. Piston 236 may be coupled to a crankshaft 240 via a connecting rod, along with other pistons of the engine. Crankshaft 240 may be operatively coupled with drive wheel 130, motor 120 or generator 160 via a transmission.

Cylinder 200 may receive intake air via an intake passage 242. Intake passage 242 may also communicate with other cylinders of engine 110. Intake passage 242 may include a throttle 262 including a throttle plate 264 that may be adjusted by control system 190 to vary the flow of intake air that is provided to the engine cylinders. Cylinder 200 can communicate with intake passage 242 via one or more intake valves 252. Cylinder 200 may exhaust products of combustion via an exhaust passage 248. Cylinder 200 can communicate with exhaust passage 248 via one or more exhaust valves 254.

In some embodiments, cylinder 200 may optionally include a spark plug 292, which may be actuated by an ignition system 288. A fuel injector 266 may be provided in the cylinder to deliver fuel directly thereto. However, in other embodiments, the fuel injector may be arranged within intake passage 242 upstream of intake valve 252. Fuel injector 266 may be actuated by a driver 268.

Emission control device (ECD) 270 is shown arranged along exhaust passage 248 downstream of exhaust gas sensor 226, and may include a plurality of emission control devices. The one or more emission control devices may include a three-way catalyst, lean NOx trap, particulate filter, oxidation catalyst, etc. In the example shown in FIG. 2, ECD 270 includes the three-way catalyst (TWC) 271 and the particulate filter (PF) 272. For example, engine 110 may comprise a gasoline engine with ECD 270 including a particulate filter 272 for reducing and maintaining engine exhaust particulate emissions below regulated emission standards. In some embodiments, PF 272 may be located downstream of the TWC 271 (as shown in FIG. 2), while in other embodiments, PF 272 may be positioned upstream of the TWC. Further, PF 272 may be arranged between two or more three-way catalysts, or other emission control devices (e.g., selective catalytic reduction system, NOx trap) or combinations thereof. In other embodiments, TWC 271 and PF 272 (and other ECD devices) may be integrated in a unitary housing as shown in FIG. 2. Further, in some embodiments, PF 272 may include one or more catalyst materials and/or oxygen storage materials. As described in further detail below, various operational aspects of engine 10 may be controlled to facilitate the performance of ECD 270, including but not limited to regeneration of PF 272.

In one example, the ECD 270 may include an ECD sensor 273 that transmits a signal NPF to control system 190 when a new emission control device such as a new particle filter is installed. Accordingly, ECD sensor 273 may transmit the signal NPF to control system 190 for the case of a new engine or vehicle. In response, control system 190 may display an indicator (e.g., an indicator light and/or sound at the message center 196) notifying the operator of the newly installed PF 272. Accordingly, the operator may responsively add a measured amount of fuel doped with ash-producing additive, or a measured amount of dopant (e.g., ash-producing additive) to the fuel tank such that during engine operation, combustion of the doped fuel aids in coating the newly installed ECD device (e.g., new PF) with ash. Alternately, or additionally, the control system 190 may, in response to an indication of a newly installed PF 272, operate fuel additive metering valve 148 to meter fuel additives from fuel additive storage tank 147 to fuel tank 144, thereby doping the fuel. Combustion of the doped fuel may produce ash which deposits as an ash coating on the surfaces of the new PF 272. The ash coating may help in rapidly increasing the particle filtration efficiency of the newly installed particle filter as the doped fuel is combusted during vehicle operation, as further described below.

A non-limiting example of control system 190 is depicted schematically in FIG. 2. Control system 190 may include a processing subsystem (CPU) 202, which may include one or more processors. CPU 202 may communicate with memory, including one or more of read-only memory (ROM) 206, random-access memory (RAM) 208, and keep-alive memory (KAM) 210. As a non-limiting example, this memory may store instructions that are executable by the processing subsystem. The process flows, functionality, and methods described herein may be represented as instructions stored at the memory of the control system that may be executed by the processing subsystem.

CPU 202 can communicate with various sensors and actuators of engine 110 via an input/output device 204. As a non-limiting example, these sensors may provide sensory feedback in the form of operating condition information to the control system, and may include: an indication of mass airflow (MAF) through intake passage 242 via sensor 220, an indication of manifold air pressure (MAP) via sensor 222, an indication of throttle position (TP) via throttle 262, an indication of engine coolant temperature (ECT) via sensor 212 which may communicate with coolant passage 214, an indication of engine speed (PIP) via sensor 218, an indication of exhaust gas oxygen content (EGO) via exhaust gas composition sensor 226, an indication of PCV exhaust gas moisture and hydrocarbon content via PCV exhaust line gas sensor 233, an indication of intake valve position via sensor 255, and an indication of exhaust valve position via sensor 257, among others. For example, sensor 233 may be a humidity sensor, oxygen sensor, hydrocarbon sensor, and/or combinations thereof. Sensor 273 may be an ECD sensor that detects a newly installed ECD such as a newly installed PF 72. When a PF 72 is newly installed in the vehicle (e.g., a new vehicle or a replacement PF 72 is installed), sensor 273 may send a signal NPF to control system 190, and control system 190 may responsively provide an indication to the operator of the NPF signal at the message center 196.

Furthermore, the control system may control operation of the engine 110, including cylinder 200 via one or more of the following actuators: driver 268 to vary fuel injection timing and quantity, ignition system 288 to vary spark timing and energy, intake valve actuator 251 to vary intake valve timing, exhaust valve actuator 253 to vary exhaust valve timing, and throttle 262 to vary the position of throttle plate 264, among others. Note that intake and exhaust valve actuators 251 and 253 may include electromagnetic valve actuators (EVA) and/or cam-follower based actuators.

Turning now to FIG. 3, it illustrates an example configuration of an exhaust particulate filter 300. Exhaust particulate filter 300 may be installed in engine 110 of vehicle propulsion system 100 to reduce and maintain exhaust particulate emissions below emission standards. As described above, engine 110 may comprise a gasoline combustion engine. In this way particulate matter such as ash and soot generated from fuel combustion in engine 110 and exhausted from engine 110 may be largely trapped and filtered to lower particulate emissions to the vehicle environment. As shown in FIG. 3, in one example, exhaust particulate filter 300 may be a wall-flow particulate filter, comprising a substrate having a plurality of parallel pore flow channels or cells (330 and 320). In other examples, an exhaust particulate filter may include a metallic foam filter and/or a metallic fiber filter. Each parallel pore flow channel may be defined by internal porous walls 310 that are permeable to exhaust gas but semi-permeable to the exhaust particulate matter. Furthermore, inlet and/or outlet ends of the parallel pore flow channels may be selectively plugged such that at an inflow end 302 of the exhaust particulate filter 300, a plurality of the parallel pore flow channels may include plugged ends 320 while the remaining parallel pore flow channels may include open ends 330. As depicted in FIG. 3, the distribution of parallel pore flow channels with plugged ends 320 and parallel pore flow channels with open ends 330 may be in a checkerboard pattern or another suitable pattern that distributes plugged ends and open ends approximately uniformly across a cross-section of the filter perpendicular to the exhaust flow direction 390. Plugged ends 320 may be impermeable to exhaust gas, or largely impermeable to exhaust gas and particulate matter. Furthermore, parallel pore flow channels having plugged ends 320 at the inflow end 302 may have open ends 330 at the outflow end 304, whereas parallel pore flow channels having open ends 320 at the inflow end 302 may have plugged ends 320 at the outflow end 304. In this manner, exhaust gas flowing into the exhaust particulate filter 300 at the inflow end 302 (e.g., through both open ends 330 and plugged ends 320) may be directed through the internal porous walls between adjacent parallel pore flow channels, thereby increasing the flux of exhaust gas through the internal porous walls of the exhaust particulate filter 300 and increasing filtration efficiency since exhaust particulate matter may be better retained in the porous walls of the filter (as compared to if there were no plugged ends 320).

As exhaust particulate matter is retained by the internal porous walls 310 of exhaust particulate filter 300, filtration efficiency (e.g., a metric quantifying the number of particles retained by the filter as compared to the number of particles passing through the filter) may increase relative to filtration efficiency of a newly installed particulate filter because the retained particulate may be deposited in the pores of the internal porous walls 310, effectively reducing the pore dimension. Furthermore, free particulate matter flowing through the filter may have a higher affinity to deposit on retained particulate matter in the internal porous walls 310 as compared to the affinity of free particulate matter on the clean filter surface without any retained particulate matter, which can also contribute to increased filtration efficiency.

Particulate matter may comprise soot and ash. Soot may include combustible matter such as carbon, sulfates, and organic matter, whereas ash may include incombustible material such as metal oxides, sulfates, and phosphates. Ash may originate from lubricant additives, engine wear metals, and trace metals in fuel, among other sources. Ash may accumulate within the exhaust particulate filter along the internal porous walls 310 and at a plugged end 320 at an outflow end 304 of the filter. Combustion of diesel fuel in conventional diesel engines produces exhaust particulate matter including soot and ash at levels that are significantly higher than levels of particulate matter arising from combustion of gasoline in conventional gasoline engines. Accordingly, accumulation of higher levels of ash in diesel particulate filters may restrict flow through the diesel particulate filter and significantly increase the filter back pressure across the filter, thereby reducing the flow of exhaust through the filter and reducing fuel economy. In contrast, gasoline engines burn much cleaner than diesel engines and exhibit low levels of ash in the exhaust. Ash levels in the exhaust from gasoline (undoped with ash-producing additives) combustion does not appreciably accumulate in particulate filters or increase particulate filter back pressure. As described herein, doping gasoline with ash-producing additives in response to installation of a new exhaust particulate filter may increase filter efficiency. The amount of ash-producing additives in the doped gasoline may be high enough to increase filter efficiency, but low enough so as to not appreciably increase the exhaust particulate filter back pressure.

Turning now to FIG. 4, it illustrates a graph showing data of filtration efficiency (e.g., particle number efficiency) versus soot loading for two types of exhaust particulate filters, C650 and C680. The C650 filter represents an exhaust particulate filter having a higher porosity of 65% and the C680 filter represents an exhaust particulate filter having a lower porosity of 48%. Particle number (PN) efficiency may be calculated by subtracting the cumulative tailpipe exhaust gas PN (downstream from the particulate filter) from the cumulative feed gas PN upstream of the particulate filter, and dividing this difference by the cumulate feed gas PN. % PN efficiency may be determined by multiplying the above quotient by 100%. The C650 blank and C680 blank data sets (open circle and open square markers) represent data for C650 and C680 filters with no ash coating (e.g., clean filters) deposited on the filter substrate. The C650 with ash and C680 with ash data sets (filled circle and filled square markers) represent data for C650 and C680 filters with an ash coating deposited on the filter substrate internal porous walls. The ash coating is produced by combusting gasoline doped with an ash-producing additive, and directing the resultant combustion exhaust gases and ash particulate matter to the filter. In this way, ash-producing additives doped in the fuel can generate a thin layer of ash on the filter walls. Examples of the ash-producing additive include lubricant additives such as zinc dialkyldithiophosphates (ZDDP) and calcium sulfonates.

The C650 and C680 clean and ash-coated (w/ash) filters were exposed to exhaust from combustion of non-doped gasoline fuel and filtration efficiency was measured as a function of loading. Soot loading refers to the amount of soot particulate matter deposited on the filter during normal engine operation and resulting from combustion of undoped fuel. In other words, for the C650 with ash and C680 with ash filter data, the soot loading refers to the soot loading deposited on the particulate filter from combustion of undoped fuel, after doped fuel combustion. For the C650 blank and C680 blank filter data, the soot loading refers to the soot loading deposited on the particulate filter from combustion of undoped fuel on clean filters.

The data of FIG. 4 show that an ash coating (resulting from combustion of doped fuel on a clean filter) comprising an ash loading of 0.14 g/L (g of ash per unit filter volume) and 0.21 g/L may significantly increase filtration efficiencies as compared to the uncoated clean filter values over a range of soot loading values. For example, at soot loadings <0.10 g/L, the ash coating from combustion of doped fuel increases the filtration efficiency to about 0.85 (ash-coated filter) from about 0.65 (clean filter), an increase of more than 30% as shown by arrow 410. Furthermore, the filtration efficiency rapidly increases to 100% with increasing soot loading for filters with ash coating from combustion of doped fuel. For example, for the C650 particulate filter, filtration efficiency approaches 100% at a soot loading just above 0.2 g/L and for the C680 particulate filter filtration efficiency is at 100% at soot loadings <0.05 g/L. Accordingly, ash-coated particulate filters arising from combustion of doped fuel may achieve high filtration efficiencies at much lower soot loading values as compared to conventional diesel particulate filters, which exhibit high filtration efficiencies at soot loadings typically greater than 2.0 g/L. At soot loadings of less than 0.5 g/L, conventional particulate filters (with no ash coating from combustion of doped fuel) can exhibit filtration efficiencies significantly less than 100%, particularly with high porosity filters (e.g., porosity>55%) that exhibit low initial (e.g., at 0 g/L soot loading) filtration efficiencies of about 50%. For example the C650 filter (porosity of 65%) with no ash coating (e.g. open circle data points in FIG. 4 corresponding to C650 Blank) may exhibit an initial filtration efficiency of approximately 50%. Furthermore, achieving high filtration efficiencies at lower soot loading values is advantageous because doing so aids in meeting lower emission standards at lower vehicle mileage, and aids in significantly reducing exhaust particulate emissions.

Example ZDDP ash-producing additives that may be used for doping fuel may include but are not limited to one or more of Zinc O,O-di(C1-14-alkyl) dithiophosphates, Zinc (mixed O,O-bis(sec-butyl and isooctyl)) dithiophosphates, Zinc-O,O-bis(branched and linear C3-8-alkyl) dithiophosphates, Zinc O,O-bis(2-ethylhexyl) dithiophosphate, Zinc O,O-bis(mixed isobutyl and pentyl) dithiophosphates, Zinc mixed O,O-bis(1,3-dimethylbutyl and isopropyl) dithiophosphates, Zinc O,O-diisooctyl dithiophosphate, Zinc O,O-dibutyl dithiophosphate, Zinc mixed O,O-bis(2-ethylhexyl and isobutyl and isopropyl) dithiophosphates, Zinc O,O-bis (dodecylphenyl) dithiophosphate, Zinc O,O-diisodecyl dithiophosphate, Zinc O-(6-methylheptyl)-O-(1-methylpropyl) dithiophosphate, Zinc O-(2-ethylhexyl)-O-(isobutyl) dithiophosphate, Zinc O,O-diisopropyl dithiophosphate, Zinc (mixed hexyl and isopropyl) dithiophosphates, Zinc (mixed O-(2-ethylhexyl) and O-isopropyl) dithiophosphates, Zinc O,O-dioctyl dithiophosphate, Zinc O,O-dipentyl dithiophosphate, Zinc O-(2-methylbutyl)-O-(2-methylpropyl) dithiophosphate, and Zinc O-(3-methylbutyl)-O-(2-methylpropyl) dithiophosphate. Other ZDDP additives may also be used.

In addition to doping fuel with standard oil lubricant additives in response to installation of a new particulate filter, fuel may also be doped with oxygen-storage materials in response to installation of a new particulate filter, such as metal oxides. Doping fuel with metal oxides may aid in filtration efficiency by producing ash and may aid in regeneration of ECD. Example metal oxide additives may include one or more of (but are not limited to) iron, iron-strontium, cerium, cerium-iron, platinum, platinum-cerium, and copper. In some examples, fuel borne catalysts, including the above-mentioned metal oxide additives, may be employed for fuel doping. Metal oxides such as calcium oxide, zinc oxide, and iron oxide may also be used.

Turning now to FIG. 5, it illustrates filtration efficiencies for various full size exhaust particulate substrates wash coated to 1.0 g/ft$^3$ and fully (e.g., full useful life) aged in an engine dynamometer to 50 hours with doped fuel. The aging in the engine dynamometer used 30 mg/gal of ZDDP dopant in the fuel and about 200 gal of fuel. The ash loaded substrate represents clean substrates aged in the engine dynamometer with doped fuel (e.g., combustion of the doped fuel produces an ash loaded substrate). Substrate ID's 1-3 represent substrates having a lower, approximately 7.6 g/L, ash loading on the substrate's surfaces. Substrate ID's 4-6 represent substrates having a higher, approximately 10.4 g/L, ash loading on the substrate's surfaces. As shown from FIG. 5, the filtration efficiencies of the ash loaded substrates increase from 13% to 25% above their clean substrate counterparts. In the case of FIG. 5, the substrates 4-6 having the higher ash loading achieve larger increases in PN efficiencies over their clean substrate counterparts, as compared with the substrates 1-3 having the lower ash loading. Accordingly, combusting doped fuel to produce ash coated particulate filters can significantly increase filtration efficiencies of particulate filters. Combustion of one tank of 20 gal of doped fuel with a dopant (e.g., ash-producing additive) concentration of 300 mg/gal may be used in a vehicle system to achieve an equivalent increase in filtration efficiency as the substrates tested in the aged dynamometer system data of FIG. 5.

Turning now to FIG. 6, it illustrates exhaust particulate filter pore cross-sectional morphology during ash deposition from a clean (e.g., newly installed) exhaust particulate filter 650 to an exhaust particulate filter exhibiting full useful life ash deposition 658 in a gasoline engine system. In other words, filter age increases from clean filter 650, to partially aged (ash-coated) filters 652, 654, and 656, and to full useful life ash filter 658. As depicted by arrow 610, back pressure across the particulate filter increases with increasing ash deposition on the particulate filter walls. As indicated by arrow 612, filtration efficiency increases with increasing ash deposition on the particulate filter walls after an initial loading of ash is deposited at 652.

In diesel engine systems, where particulate matter levels are higher as compared to gasoline engines, ash deposition typically begins at the rear (e.g., outflow end) of the filter pore flow channels, whereby the ash gradually deposits and fills the filter pores in a pore axial direction, plugging the pore flow channels and decreasing the effective filtration length of the pore flow channels as the filter ages. In gasoline engines, overall ash particulate matter levels are much lower, and ash particles tend to deposit on existing ash particles at the surface of the pore flow channel walls as illustrated in FIG. 6. Thus, as the particulate filter ages, the filter pore flow channel cross-section (e.g., perpendicular to the main inflow direction of exhaust gas into the filter) becomes gradually occluded from a pore flow channel cross-section of a clean filter 650 to pore flow channel cross-section of a full useful life ash-loaded filter 658.

After forming an initial coating of ash on a clean substrate filter as shown at 652, the rate of increase in ash coating thickness slows as a portion of the incoming ash particulate begins to tumble along the pore flow channels towards the rear of the filter. Thus, the ash coating may reach an equilibrium thickness as depicted by ash deposited filter 652, wherein the thin coating of ash deposited filter at 652 may exhibit advantageous characteristics of increased filtration efficiencies as compared to a clean filter at 650, while still maintaining low levels of back pressure as compared to filters with higher levels of ash deposition (e.g., 654, 656, 658). Combustion of fuel doped with an ash-producing additive following installation of a new particulate filter can thus be a method of achieving a partially aged ash-coated filter 652 that exhibits an increase in filtration efficiency meeting or exceeding the 4 k emission standards, while maintaining low filter back pressures. Furthermore, the amount of ash deposited (and the ash coating thickness) can be controlled by varying the amount of ash-producing dopant in the fuel combusted, or by varying the amount of doped fuel to be combusted.

Based on emission experiments performed on fuel useful life gasoline engine particulate matter filters, full useful life ash loading may be from 30 to 60 g of ash, depending on oil consumption, wash coat loading, loss of upstream flow through three-way catalysts, and quality of steel used in the exhaust system. For example, higher oil consumption and lower quality of steel may generate higher quantities of ash as compared to lower oil consumption and higher quality of steel, respectively. Retention of exhaust flow in upstream emission control devices such as three-way catalysts may reduce ash loading in the particulate filter since less exhaust flow reaches the particulate filter.

In one example, an increase in filtration efficiency meeting 4 k emission standards may be achieved for a filter by depositing an ash coating comprising 10-15% of the full useful life ash. Accordingly, for a particulate filter having a full useful life ash loading of 45 g, a volume of doped fuel may be combusted to generate 4.5 g-6.75 g of ash. For example, in the case of a typical 25 gal automobile fuel tank, combusting 25 gal of gasoline with 0.0615 g/L of ZDDP and 0.045 g/L of calcium sulfonate additives in the fuel would generate and expose the exhaust particulate filter to approximately 5 g of ash. Doping the fuel with more than one dopant may aid in reducing a density or compactedness of the layer of ash produced on the exhaust particulate filter upon combustion of the doped fuel. Reducing the density or compactedness of the layer of ash produced on the exhaust particulate filter may aid in maintain or reducing back pressures across the exhaust particulate filter. For example, the density or compactedness of the ash layer produced on the exhaust particulate filter upon combusting fuel doped with both ZDDP and calcium sulfonate may be less than that produced on the exhaust particulate filter upon combusting fuel doped with ZDDP or calcium sulfonate alone.

Selection and design of exhaust particulate filters generally balance back pressure, filtration efficiency, strength, cost, and performance. For example, the conventional solution of membrane integration on the filter surface may reduce back pressure and elevate filtration efficiency, but can be very costly. Furthermore, high porosity filter substrates can marginally increase filtration efficiencies depending on the amount of wash coat. However, substrates with high amounts of wash coat exhibit drastic increases in back pressure. In contrast, combustion of fuel doped with an ash-producing additive following installation of a new particulate filter can produce an ash-coated filter 652 that exhibits an increase in filtration efficiency meeting or exceeding the 4 k emission standards, while maintaining low filter back pressures. Furthermore, the amount of ash deposited (and the ash coating thickness) can be controlled by varying the amount of ash-producing dopant in the fuel combusted, or by varying the amount of doped fuel to be combusted, thereby tuning the filter characteristics (e.g., filter efficiency, back pressure, and the like).

Turning now to FIG. 7, it illustrates a method 700 for doping fuel with an ash-producing additive in response to installation of a new particulate filter. Instructions for carrying out method 700 and the rest of the methods included herein may be executed by a controller, such as control system 190, based on instructions stored on a memory of the controller and in conjunction with signals received from sensors of the engine system, such as the sensors described above with reference to FIGS. 1-2. The controller may employ engine actuators of the engine system to adjust engine operation, according to the methods described below. For example, responsive to installation of a new exhaust particle filter, control system 190 may dope fuel with ash-producing additives from fuel additive storage tank 147 via fuel additive metering valve 148.

Method 700 begins at 710 where vehicle operating conditions such as torque (Tq), vehicle speed (Vs), particulate filter status, and the like are estimated, and/or measured. Method 700 continues at 720 where it determines if a vehicle is new. For example, the vehicle may be determined to be new if the vehicle mileage is 0 or less than a threshold new mileage (e.g., 50 miles). As another example, the vehicle may be determined to be new if control system 190 is initialized and/or accessed for the first time when the engine is ON. As another example, sensor 273 may send signal to control system 190 that the vehicle system is new if the filter back pressure is equivalent to an initial back pressure of a newly installed particulate filter. If the vehicle is determined to be new, method 700 continues at 740.

If the vehicle is not determined to be new, method 700 continues at 730 where it determines if a new exhaust particle filter has been installed. A new exhaust particle filter may be installed when ECD sensor 273 sends a NPF signal to control system 190. For example, ECD sensor may send signal NPF to control system 190 when the PF 272 is removed and replaced. In another example, a vehicle technician may send signal NPF to control system 190 after servicing and replacing PF 272. As another example, sensor 273 may send signal NPF to control system 190 if the filter back pressure is equivalent to an initial back pressure of a newly installed particulate filter. If method 700 determines that the exhaust particulate filter is not newly installed, then method 700 continues at 770 where the vehicle engine is operated without fuel doping. After 770, method 700 ends.

If method 700 determines at 730 that the exhaust particle filter is newly installed, or if method 700 determines at 720 that the vehicle is new, method 700 continues at 740 where the fuel is doped with an ash-producing additive. In one example, doping the fuel with an ash-producing additive may comprise adding fuel pre-blended with a quantity of the ash-producing additive to the fuel tank. In another example, a quantity of ash-producing additive may be added to fuel already in the fuel tank. In another example, ash-producing additive may be added to the fuel tank 144 via a fuel additive storage tank 147 via fuel additive metering valve 148. In another example, the fuel additive storage tank 147 may contain fuel doped with ash-producing additive. Furthermore, the fuel doping may be carried out manually by a vehicle technician and/or vehicle operator, and may additionally or alternatively be performed through instructions executable by the control system 190. In any case, the amount of ash-producing additive and fuel in the fuel tank 144 may be measured and controlled as described above such that combustion of the fuel doped with an ash-producing additive following installation of a new particulate filter can produce an ash-coated filter 652 that exhibits an increase in filtration efficiency meeting or exceeding the 4 k emission standards, while maintaining low filter back pressures. Furthermore, the ash-producing additive may comprise lubricant additives such as ZDDP and/or calcium sulfonates, and may additionally comprise fuel borne catalysts such as metal oxides as described above.

Method 700 continues at 750 where the fuel doped with the ash-producing additive is combusted in the vehicle engine to produce ash in the engine exhaust. The combustion of the doped fuel may occur as the vehicle is operated and fueled by the doped fuel in fuel tank 144. At 760 the ash in the engine exhaust may be deposited on the surface of the exhaust particulate filter, producing a thin ash-coated filter (e.g., partially aged filter 652), which exhibits increased filter efficiency while maintaining low filter back pressure. In this way, doping fuel with an ash-producing additive may drastically increase filter efficiencies while maintaining low filter back pressures in a simple and cost-effective manner and at mileage levels well below 4 k miles. For example, combusting a full tank of gasoline doped with an ash-producing additive may be completed in less than 500 miles.

As on embodiment, a method for a vehicle may comprise: responsive to installation of a new exhaust particulate filter, doping fuel with an ash-producing additive, and combusting the doped fuel to produce ash, wherein the ash deposits as an ash coating on the new exhaust particulate filter. Additionally or alternatively, doping the fuel with the ash-producing additive may comprise doping the fuel with an oil lubricant additive. Additionally or alternatively, doping the fuel with the oil lubricant additive may comprise doping the fuel with ZDDP. Additionally or alternatively, doping the fuel with the oil lubricant additive may comprise doping the fuel with calcium sulfonate. Additionally or alternatively, the method may further comprise doping the fuel with a fuel borne catalyst. Additionally or alternatively, doping the fuel with the fuel borne catalyst may comprise doping the fuel with one of iron, cerium, platinum, and copper. Additionally or alternatively, combusting the doped fuel to produce the ash may comprise combusting the doped fuel to produce 4.5 g of ash. Additionally or alternatively, combusting the doped fuel to produce the ash may comprise combusting the doped fuel to produce 10% of a full useful life ash of the new exhaust particulate filter.

In another representation a method for a new gasoline engine may comprise installing an exhaust particulate filter, doping gasoline with an ash-producing additive, and combusting the doped gasoline to produce ash, wherein the ash deposits as an ash coating on the exhaust particulate filter. Additionally or alternatively, doping the gasoline with an ash-producing additive may comprise doping the gasoline with an oil lubricant additive. Additionally or alternatively, doping the gasoline with the oil lubricant additive may comprise doping the gasoline with ZDDP. Additionally or alternatively, doping the gasoline with the oil lubricant additive may comprise doping the gasoline with calcium sulfonate. Additionally or alternatively, the method may comprise doping the gasoline with a fuel borne catalyst. Additionally or alternatively, doping the gasoline with the fuel borne catalyst may comprise doping the gasoline with one of iron, cerium, platinum, and copper. Additionally or alternatively, combusting the doped fuel to produce the ash may comprise combusting the doped fuel to produce 4.5 g of ash. Additionally or alternatively, combusting the doped fuel to produce the ash may comprise combusting the doped fuel to produce 10% of a full useful life ash of the exhaust particulate filter.

Turning now to FIG. 8, it illustrates a timeline 800 based on vehicle mileage showing the increase in filter efficiency resulting from combustion of doped fuel after a new exhaust particulate filter is installed. Timeline 800 includes trend lines for exhaust particulate filter status 810, fuel doping status 820, and filter efficiency 830. At 0 miles, the exhaust particulate filter status is NEW since the vehicle is determined to be new, and includes a newly installed exhaust particulate filter. In response, to the exhaust particulate filter status being NEW, the fuel doping status 820 is switched ON (e.g., signal NPF is sent to control system 190) and fuel doped with ash-producing additive is added to fuel tank 144. As described above, control system 190 may, in response to detection of a newly installed exhaust particulate filter, add ash-producing additive to fuel tank 144 via fuel additive storage tank 147 and fuel additive metering valve 148. Alternately or additionally, control system 190 may generate a message at message center 196 indicating that the exhaust particulate filter has been newly installed. Additionally or alternatively, a vehicle technician, in response to the NPF signal, may manually add ash-producing additive to fuel tank 144. Once the vehicle mileage increases, the exhaust particulate status ceases to be NEW and the fuel doping status is switched OFF. Furthermore, as the vehicle mileage increases and the doped fuel is combusted in the vehicle engine, filter efficiency may increase rapidly (e.g., within 500 miles) to a high level (e.g., 100%) as the tank of doped fuel is combusted and ash generated from combustion of the ash-producing additive is deposited on the internal surfaces of the exhaust particulate filter.

At mileage of 101000 miles, the vehicle's exhaust particulate filter may reach or near its fuel useful life (e.g., filter efficiency may be low due to fuel useful life amount of ash and/or soot deposited on the filter, repeated regeneration, and the like). Accordingly, a new exhaust particulate filter may be installed in the vehicle and the exhaust particulate filter status is switched to NEW. In response to the newly installed exhaust particulate filter, the fuel doping status is switched ON, and ash-producing additive is added to fuel tank 144, as described above. As a result, as the vehicle mileage increases beyond 101000 miles, combustion of the fuel doped with ash-producing additive rapidly increases the exhaust particulate filter efficiency 830 to a high level (e.g., near 100%), while maintaining low filter back pressures.

In this way, doping fuel with an ash-producing additive may drastically increase filter efficiencies while maintaining low filter back pressures in a simple and cost-effective manner and at mileage levels well below 4 k miles. For example, combusting a full tank of gasoline doped with an ash-producing additive may be completed in less than 500 miles. Furthermore, since existing vehicle fuel tanks can be doped with ash-producing additives, the above-described advantages may be achieved with existing vehicle systems without any retrofitting or installation of additional parts. Further still, the methods described herein are generic to exhaust particle filters. For example, doping fuel with ash-producing additives and combusting the doped fuel can generate an ash coating on the surfaces and increase the efficiency of the exhaust particle filter.

In one embodiment, a vehicle system may comprise: a combustion engine; a fuel tank; an exhaust particulate filter receiving exhaust from the combustion engine; and a controller with computer readable instructions stored on non-transitory memory for, responsive to installation of a new exhaust particulate filter, doping fuel with an ash-producing additive, and combusting the doped fuel to produce ash, wherein the ash deposits as an ash coating on the new exhaust particulate filter. Additionally or alternatively, the vehicle system may comprise a fuel additive storage tank fluidly coupled to the fuel tank, wherein the fuel tank receives the ash-producing additive from the fuel additive storage tank. Additionally or alternatively, the ash-producing additive may comprise ZDDP. Additionally or alternatively, the ash-producing additive may comprise calcium sulfonate.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle, comprising:

supplying undoped fuel to a combustion engine, the undoped fuel including fuel without an ash-producing additive, combusting the undoped fuel in the combustion engine, detecting installation of a new exhaust particulate filter via scanning a label of the new exhaust particulate filter, and responsive to detecting installation of the new exhaust particulate filter via the scanning, doping fuel with the ash-producing additive, and combusting the doped fuel in the combustion engine to produce ash, wherein the ash deposits as an ash coating on the new exhaust particulate filter.

2. The method of claim 1, wherein installation of the new exhaust particulate filter includes indicating installation of the new exhaust particulate filter when a back pressure across an exhaust particulate filter is less than a threshold back pressure.

3. The method of claim 1, wherein doping fuel with the ash-producing additive includes adding fuel pre-blended with the ash-producing additive to a fuel tank on board the vehicle.

4. The method of claim 1, wherein doping fuel with the ash-producing additive includes manually adding the ash-producing additive to a fuel tank on board the vehicle.

5. The method of claim 1, wherein doping fuel with the ash-producing additive includes doping a threshold volume of fuel above a threshold ash-producing additive concentration.

6. The method of claim 5, wherein doping fuel with the ash-producing additive includes stopping doping of the fuel with the ash-producing additive in response to supplying the threshold volume of fuel with the threshold ash-producing additive concentration to the combustion engine.

7. The method of claim 1, wherein doping fuel with the ash-producing additive includes stopping doping of the fuel with the ash-producing additive in response to producing a threshold ash loading deposited on the new exhaust particulate filter.

8. The method of claim 1, wherein doping fuel with the ash-producing additive includes stopping doping of the fuel with the ash-producing additive in response to a back pressure across the new exhaust particulate filter increasing above a threshold back pressure.

9. A method for a new gasoline engine, comprising:

determining that a particulate filter is not newly installed, responsive to determining that the particulate filter is not newly installed, supplying undoped fuel to a combustion engine, the undoped fuel being fuel without doping of an ash-producing additive, combusting the undoped fuel in the combustion engine, and determining installation of a new exhaust particulate filter based on a signal received at a control system of the combustion engine, the signal received responsive to scanning a label of the new exhaust particulate filter; and in response to detecting the installation of the new exhaust particulate filter, doping gasoline with the ash-producing additive, and combusting the doped gasoline to produce ash, wherein the ash deposits as an ash coating on the new exhaust particulate filter.

10. The method of claim 9, wherein doping the gasoline with the ash-producing additive comprises doping the gasoline with an oil lubricant additive.

11. The method of claim 10, wherein doping the gasoline with the oil lubricant additive comprises doping the gasoline with ZDDP.

12. The method of claim 11, wherein doping the gasoline with the oil lubricant additive comprises doping the gasoline with calcium sulfonate.

13. The method of claim 12, further comprising doping the gasoline with a fuel borne catalyst.

14. The method of claim 13, wherein doping the gasoline with the fuel borne catalyst comprises doping the gasoline with one of iron, cerium, platinum, and copper.

15. The method of claim 9, wherein combusting the doped gasoline to produce the ash comprises combusting the doped gasoline to produce 4.5 g of ash.

16. The method of claim 9, wherein combusting the doped gasoline to produce the ash comprises combusting the doped gasoline to produce 10% of a full useful life ash of the new exhaust particulate filter.

17. A vehicle system, comprising:

a combustion engine;

a fuel tank;

an exhaust particulate filter receiving exhaust from the combustion engine; and an exhaust particulate filter sensor;

a controller, the controller communicatively coupled with the exhaust particulate filter sensor, and the controller including computer readable instructions stored on non-transitory memory for, supplying undoped fuel to the combustion engine, the undoped fuel including fuel without an ash-producing additive, combusting the undoped fuel in the combustion engine, receiving a signal from the exhaust particulate filter sensor indicating installation of a new exhaust particulate filter, the signal based on scanning a label of the new exhaust particulate filter, and responsive to receiving the signal from the sensor indicating the installation of the new exhaust particulate filter, notifying an operator of the installation of the new exhaust particulate filter via a display, doping fuel with the ash-producing additive, and combusting the doped fuel in the combustion engine to produce ash, wherein the ash deposits as an ash coating on the new exhaust particulate filter.

18. The vehicle system of claim 17, further comprising a fuel additive storage tank fluidly coupled to the fuel tank, wherein doping fuel with the ash-producing additive includes supplying fuel pre-blended with the ash-producing additive to the fuel tank.

* * * * *